United States Patent [19]

Rampe

[11] 4,232,486

[45] Nov. 11, 1980

[54] TUMBLER-TYPE FINISHING MACHINE

[75] Inventor: John F. Rampe, Mayfield Heights, Ohio

[73] Assignee: Rampe Research, Cleveland, Ohio

[21] Appl. No.: 960,630

[22] Filed: Nov. 14, 1978

[51] Int. Cl.[3] ..... B24B 31/02

[52] U.S. Cl. ..... 51/164.1; 241/175

[58] Field of Search ..... 51/163, 164.1, 164.2, 51/7; 241/175

[56] References Cited

U.S. PATENT DOCUMENTS

| | | | |
|---|---|---|---|
| 2,200,144 | 5/1940 | Zimarik | 51/164.1 |
| 2,370,792 | 3/1945 | Hoffman | 51/164.1 |
| 2,613,036 | 10/1952 | Robinson | 51/164.1 |
| 3,341,979 | 9/1967 | Davidson | 51/164.2 |
| 3,487,840 | 1/1970 | Stenzel | 51/164.1 |
| 3,500,590 | 3/1970 | Kergolan | 51/164.1 |
| 3,823,512 | 7/1974 | Kobayashi | 51/164.2 |

FOREIGN PATENT DOCUMENTS

| | | | |
|---|---|---|---|
| 1926707 | 11/1970 | Fed. Rep. of Germany | 51/164 |

*Primary Examiner*—Harold D. Whitehead
*Attorney, Agent, or Firm*—Burge & Porter Co.

[57] ABSTRACT

A heavy duty, large capacity, tiltable axis, tumbler-type finishing machine has a drum with an open end and a closed end. The drum is caged within and journaled by a supporting framework. A shaft journaled by a thrust bearing supports the drum in the vicinity of its closed end. A plurality of rollers arranged about the periphery of the open end support the drum in the vicinity of its open end. A shock absorbing drum rotation drive system is provided for rotating the drum relative to the framework about a rotation axis. An upstanding main frame cages and pivotally supports the drum support framework for movement about a pivot axis. A drum pivoting drive system is provided for moving the drum support framework relative to the upstanding frame about the pivot axis. The drum and its supporting framework may be pivoted through a full 360 degree arc for orienting the drum in an upwardly facing attitude for loading, in any selected inclined or horizontal attitude for finishing, and in a downwardly facing attitude for unloading. A removable cover is provided for selectively closing the open end of the drum. A novel hand-operated cover locking mechanism releasably secures the cover on the drum. A hand-operated cover removal and support system is provided for removing the cover from the drum and supporting the cover at a location to one side of the drum. The drum support framework and the cover removal and support system are designed to facilitate removal of a drum having a worn lining and installation of a relined drum.

24 Claims, 11 Drawing Figures

TUMBLER-TYPE FINISHING MACHINE

CROSS-REFERENCE TO RELEVANT PATENTS

BOWL-TYPE VIBRATORY FINISHING MACHINE, U.S. Pat. No. 4,091,575, issued May 30, 1978, to John F. Rampe, here the "Bowl Machine Patent."

VIBRATORY FINISHING SYSTEM, U.S. Pat. No. 4,074,466, issued Feb. 21, 1978, to John F. Rampe, here the "Tub Machine Patent."

SHOCK ABSORBING DRIVE FOR TUMBLING DRUMS AND THE LIKE, U.S. Pat. No. 2,894,406, issued July 14, 1959, to John F. Rampe, here the "Horizontal Axis Tumbler Patent."

ABRADING APPARATUS, U.S. Pat. No. 2,116,160, issued May 3, 1938, to William A. Rosenberger et al, here the "Inclined Axis Tumbler Patent."

TUMBLING BARREL, U.S. Pat. No. 965,813, issued July 26, 1910, to Hubert M. Greist, here the "Tiltable Axis Tumbler Patent."

BACKGROUND OF THE INVENTION

1. Field of the Invention

The present invention relates generally to finishing machines and, more particularly, to tumbler-type finishing machines wherein an open-end drum is supported for rotation about an axis, and the orientation of the axis is controllable to facilitate the optimum performance of a finishing cycle.

2. Prior Art

Many surface finishing operations such as deburring, burnishing, descaling, cleaning, and the like can be conducted expeditiously in a finishing machine. Two basic types of finishing machines are in common use, namely, vibratory machines and tumbler machines. Both types of machines employ receptacles adapted to receive finishing media and workpieces to be finished. Vibratory machines are provided with drive systems for vibrating their receptacles to impart a precessing type of movement to the contents of the receptacles whereby workpieces and media are circulated together in the presence of vibration to cause the media to impart a finishing action to the workpieces. Tumbler machines are provided with drive systems for rotating their receptacles to impart a tumbling-type movement to the contents of the receptacles whereby the media is caused to impact the workpieces to effect a finishing action.

Vibratory finishing machines are of essentially two types, namely, bowl machines and tub machines. In bowl machines, the receptacle is of an essentially annular configuration and provides a toroidal-shaped, upwardly opening trough through which media and workpieces churn and precess as a vertically oriented drive system vibrates the bowl. In tub machines, the receptacle is ordinarily of elongate configuration and defines an elongate, upwardly opening trough wherein media and workpieces are caused to churn and precess under the influence of an essentially horizontally oriented drive system. The referenced Bowl Machine and Tub Machine Patents provide examples of these two types of vibratory finishing machines.

Tumbler machines are of essentially two types, namely, fixed axis machines and tiltable axis machines. Fixed axis machines may have their axes oriented either horizontally or at a predetermined angle of inclination. Where the fixed axis extends horizontally, the finishing receptacle ordinarily takes the form of a barrel having closed ends with both ends being journaled for rotation to securely support the barrel. Where the axis is oriented in an inclined attitude, the receptacle ordinarily takes the form of a drum having an open, upwardly facing end. The drum is supported for rotation on a shaft cantilevered to the closed lower end of the drum. Examples of these two types of fixed axis machines are provided by the referenced Horizontal Axis Tumbler and Inclined Axis Tumbler Patents.

Tiltable axis tumbler machines are preferred over other types of finishing machines for a number of types of finishing operations, particularly those where finishing conditions need to be controllably varied during different stages of their finishing cycles. Tiltable axis tumblers are typically provided with a drum-type finishing receptacle having an open end and a closed end. The drum is typically supported for rotation by means of a shaft which is cantilevered to the closed end of the drum. An advantage of tiltable axis tumblers is that the open end of the drum may be oriented in an upwardly facing attitude for loading, an inclined or horizontal attitude for performing a finishing operation, and a downwardly facing attitude for unloading. An example of a tiltable axis tumbler machine is provided by the referenced Tiltable Axis Tumbler Patent.

As is brought out in introductory portions of the referenced Inclined Axis Tumbler Patent, it is known in the art to provide a tiltable axis tumbler with a door for closing the open end of its drum. When a finishing operation has been completed, the drum is oriented with its discharge door facing upwardly, at which time the door is unlocked and a crane is used to lift the door from the open end of the drum. The drum is then rotated to orient its open end in a downwardly facing attitude to effect unloading. As is emphasized in the referenced Inclined Axis Tumbler Patent, the procedures involved in orienting the drum in an upwardly facing attitude, positioning a crane for removal of the door, effecting door removal, and reorienting the drum for discharge are complicated and time-consuming, and accordingly significantly increase the cost of a finishing cycle.

Prior to the existence of the present invention, the largest known tiltable axis tumblers provided a maximum capacity of about 20 cubic feet. These machines were designed to receive maximum loadings of about 150 to 200 pounds per cubic foot. Tiltable axis tumblers having a capacity approaching 30 cubic feet and larger, and adapted to receive loadings of up to 400 pounds per cubic foot have not been available, although machines of this large capacity would clearly be desirable. For example, loadings on the order of 400 pounds per cubic foot are desirable for many types of finishing operations in order that steel shot and other relatively heavy, fast-acting media can be used. In part, it is believed that large capacity tiltable axis tumblers have not been available because prior tiltable axis tumbler designs are not applicable to the scale of the tumblers contemplated here.

Many tiltable axis tumblers of the open end type are provided with an inherently unbalanced drum and drive system. The problem of imbalance is frequently magnified quite significantly when the drum is loaded with workpieces and finishing media. In large capacity machines, unbalanced systems of the type commonly used in smaller capacity machines would require the provision of unwieldy large components to withstand the force imbalance.

While previously proposed tiltable axis tumblers have been provided with variable-speed drive systems and with power-operated, drum-axis orientation controls, substantial amounts of time have been occupied in opening the drum, loading the drum, closing the drum, orienting the drum for finishing, adjusting speed of rotation to achieve a desired type of finishing action, stopping and reorienting the drum for cover removal, removing the cover, and reorienting the drum for discharge. Prior tumbler finishing machines have not been able to be loaded and unloaded rapidly, particularly where these machines have had drums of relatively large capacity provided with a heavy and unwieldy cover.

Finishing machine receptacles are normally lined with a relatively resilient material to cushion the impact of finishing media and workpieces against the walls of the receptacle. The lining is worn away under the repeated impact forces of the finishing media and workpieces. While lining materials having relatively long lives are employed in these receptacles, after a substantial amount of operation the receptacles must be removed from the machines and relined. In many finishing machine installations, a spare, relined receptacle is kept at hand so that when a receptacle lining needs to be replaced, the spare, relined receptacle is substituted for the worn receptacle and the worn receptacle is returned to the manufacturer for relining. Where finishing receptacles are of relatively large capacity, the procedure of removing a receptacle from a finishing machine and replacing it with a relined receptacle can be time consuming. Many previous tumbler machines have had drum-mounting systems that are not well adapted to facilitate drum removal and replacement.

During the operation of a tumbler, components of the machine are subjected to numerous transient loads and shocks. As material contained when the receptacle continuously rises and falls within the receptacle, repeated shocks are transmitted from the receptacle through its drive system to other components of the machine. Where relatively large receptacles having high loading capabilities are employed, the several startings and stoppings of drum rotation which may be employed during a given finishing cycle add to the shocks imposed on the drive system and on other supporting components. As the drum is tilted to different attitudes during a finishing cycle, corresponding movements are imparted to the contents of the drum, which result in the falling of contents within the drum and the imposition of still further transient loads and shocks on the drive system and related components. While the need for a shock absorbing drive in tumbler machines is noted in the referenced Horizontal Axis Tumbler Patent, the type of shock absorbing drive system described in this patent has not proved entirely effective in isolating transient loads in more heavy-duty, large capacity tiltable axis tumblers.

A further problem encountered with tiltable axis tumblers is that of providing a drive system which is not position sensitive and which can, therefore, be used to rotate the drum regardless of the orientation of the drum rotation axis. Still another problem is that of providing a drive system that is not damaged by such finishing liquids and chemicals as may be utilized in conjunction with the operation of the finishing machine.

SUMMARY OF THE INVENTION

The present invention overcomes the foregoing and other disadvantages of prior art proposals by providing a novel and improved, large capacity, tumbler-type finishing machine, including a particularly effective shock absorbing drive system for rotating the drum. The drive system employs a hydraulic motor which is unaffected by orientation and which is sealed against chemical damage. The drum rotation axis can be tilted through the operation of a tilt drive, and can be swung through a full 360 degree arc for positioning the drum in literally any desired orientation attitude. A tumbler embodying features of the present invention can be loaded and unloaded quickly and easily and is capable of readily positioning its drum in any of a wide range of attitudes during different portions of a finishing cycle. The machine is designed to facilitate the replacement of a worn drum with a relined drum and includes a built-in crane for moving drums into and out of the drum support framework.

In accordance with the preferred practice of the present invention, a tumbler apparatus includes an open ended drum adapted to receive finishing media and workpieces to be finished. The drum is rotatable about a rotation axis and is carried by a supporting framework on which a drive system is mounted for rotating the drum. The framework is pivotally supported by an upstanding frame for movement about a pivot axis. The pivot axis is arranged to extend substantially through the center of gravity of the drum in order that the drum can be of an essentially self-balancing character regardless of whether it is empty or loaded and regardless of its orientation.

The drum support framework rotatably supports the drum in the vicinities of both its open and closed ends. A series of rollers are provided for rotatably engaging the rim of the open end, and a bearing block journals a drive shaft which is cantilevered to the closed end. By this arrangement, the loading imposed on the drum support framework is received at locations on opposite sides of the pivot axis to minimize imbalance forces and to provide a stable and effective support for the drum.

A very significant feature of the drum support system of the present invention lies in the fact that, despite the extremely large size of the machine and its several components, the drum can be supported for operation in essentially any attitude of axis orientation. The drum can be positioned with its open end facing upwardly for loading, can be tilted to either side of a vertical plane for finishing operations, and can be oriented in a downwardly opening attitude for discharge. If a finishing operation is desirably carried out with the drum oriented at a predetermined angle of inclination as measured from the vertical, the first half of a finishing cycle can be carried out with the drum tilted to one side at the predetermined angle of inclination, and the last half of the cycle can be carried with the drum tilted to the other side at the same predetermined angle of inclination. This alternate side positioning helps assure that a thorough finishing action is carried out during each finishing cycle. By this system, workpieces can be finished faster and with better consistency than has heretofore been possible.

In order that a large quantity of workpieces may be processed at one time, the drum is preferably quite large, preferably on the order of 30 to 50 cubic feet in capacity. Moreover, the machine is designed to accommodate loadings of up to 400 pounds per cubic foot. By this arrangement, steel balls can be utilized as finishing media as is often desired to effect high speed finishing operations.

Where such a large drum is utilized, it will be appreciated that the attendant drive and support components of the machine must be quite robust. A heavy cover is provided to contain the finishing media and workpieces within the drum during a tumbling operation. A door removal and support carriage is provided for lifting the cover from the drum and for positioning the cover to one side of the drum when the cover is not in use. The cover removal and support carriage is provided with a winch for engaging and lifting the cover and for securely supporting it when the cover is not in use. A feature of the roller carriage is that its winch may be utilized to effect drum replacement when a drum with a worn lining is to be replaced with a relined drum. A feature of the drum support framework is that portions of it are designed to facilitate their ready removal to clear a path for drum movement during the replacement of a drum.

A particularly effective shock absorbing drive system is mounted on the drum support framework for rotating the drum. This system utilizes a hydraulic motor having a high pressure fluid input and a low pressure fluid output. The motor is of a commercially available variable speed type. In view of the high transient loads which are imposed on the drive system during the tumbling process, two types of shock absorbers are included within the drive system. In one form, a shock absorbing mechanism somewhat similar to that described in the referenced Horizontal Axis Tumbler Patent is employed to resiliently mount the hydraulic motor. In another form, the hydraulic motor is provided with a pressure relief valve interposed, externally of the motor, between the high pressure fluid inlet and the low pressure fluid outlet. When transient loads imposed on the drive system cause the pressure differential between the inlet and the outlet to exceed a predetermined limit, the pressure relief valve permits high pressure fluid from the inlet to bypass the motor to prevent damage to the drive system and to cushion transient shock. This dual shock absorbing system is found to be highly effective and reliable in minimizing transient loads and shocks transmitted from the drum through the drive system to other components of the machine.

A further feature of the invention lies in the provision of a readily adjustable lid locking mechanism for clamping the lid in sealing engagement with the open end of the drum. An over-center locking mechanism employing a plurality of radially extensible fingers is carried on the cover for engagement with a corresponding number of receiving brackets carried about the circumference of the drum rim. The radially extensible fingers are provided with inclined surfaces which engage adjustable fasteners supported by the locking brackets. Each of the fasteners is adjustable inwardly and outwardly along an axis which extends substantially orthogonally of the inclined plane of its associated finger. By adjusting these fasteners, the pressure imparted to the cover at the locations of each of the fingers is controlled and can be adjusted easily to accommodate wear.

The foregoing advantages and a fuller understanding of the invention described and claimed in the present application may be had referring to the following description and claims taken in conjunction with the accompanying drawings.

DESCRIPTION OF THE PREFERRED EMBODIMENT

Figure 1:
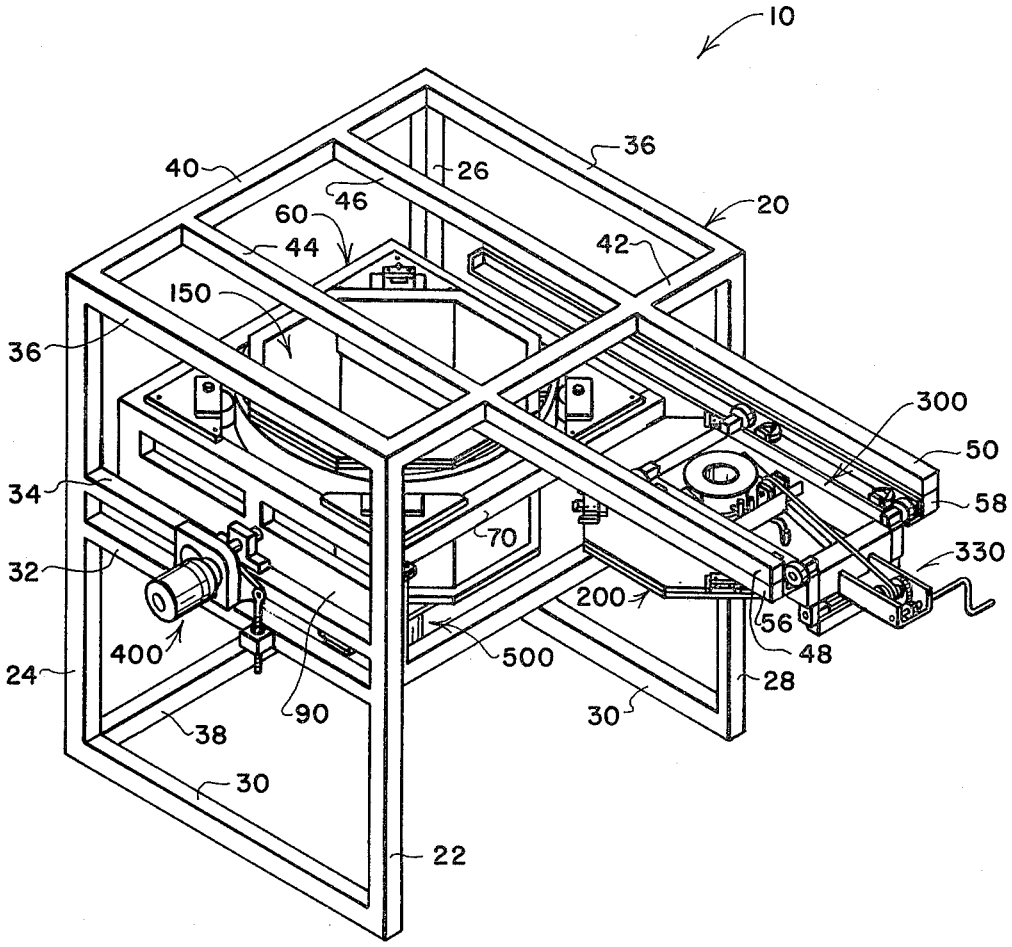
FIG. 1 is a perspective view of a tumbler-type finishing machine embodying the preferred practice of the present invention, the machine being shown with the open end of its tumbler drum facing upwardly and with the drum cover removed and supported on a roller carriage positioned at one side of the drum.

Referring to FIG. 1, a tumbler-type finishing machine is indicated generally by the numeral 10. The machine 10 includes as its major components an upstanding main frame 20, a drum support framework 60, a rotatable drum 150, a removable drum cover 200, and a drum cover removal and support system 300.

Figure 3:
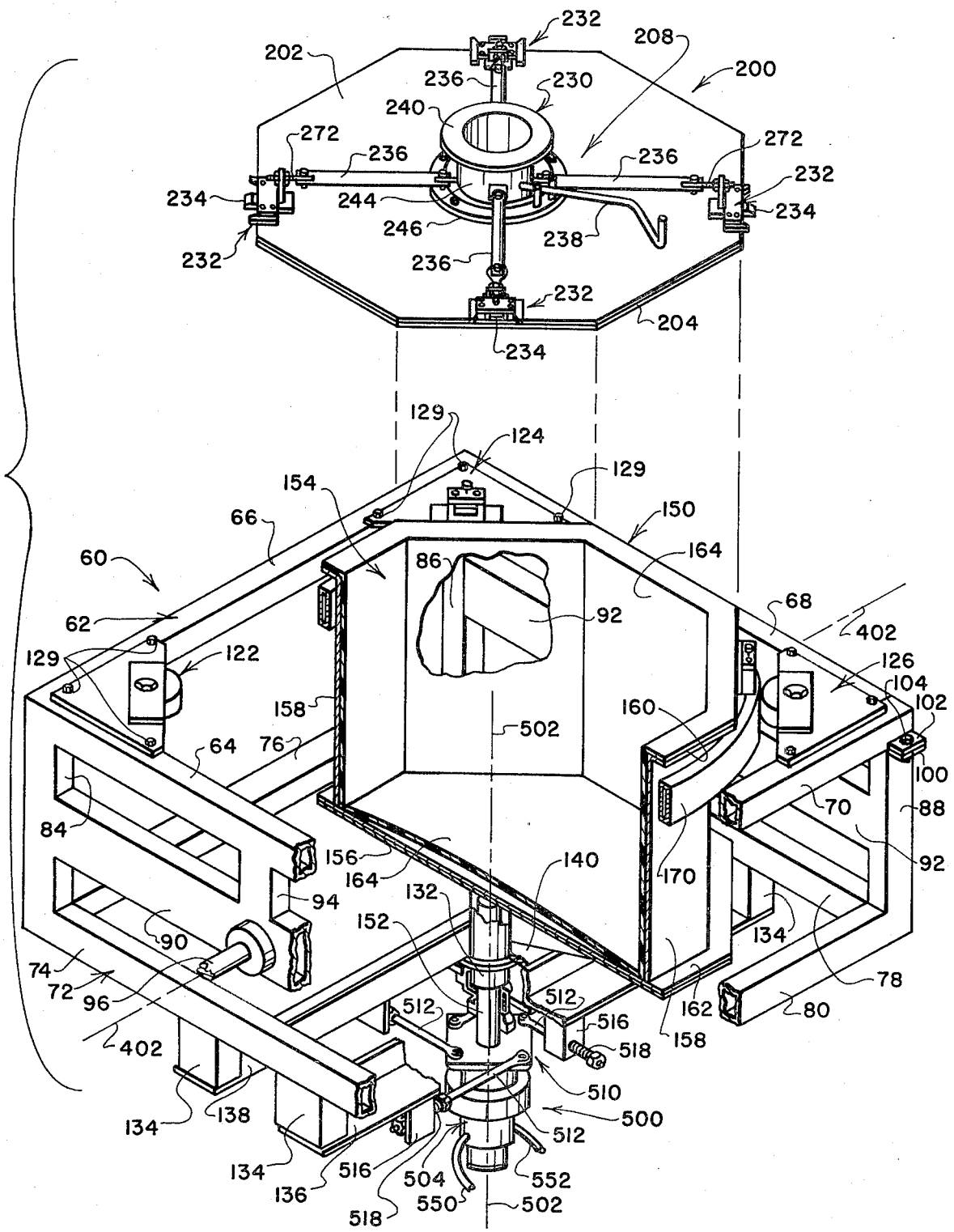
FIG. 3 is a perspective view on the same scale as FIG. 2 of portions of the machine including the drum broken away, and with the drum cover shown positioned apart from the drum.

Two drive systems operate to relatively position the frame 20, the framework 60 and the drum 150. A drum tilting drive system 400 is interposed between the main frame 20 and the drum support framework 60. Referring to FIG. 3, a drum rotation drive system 500 is interposed between the drum support framework 60 and the drum 150. The drum tilting drive system 400 is operative to pivot the drum support framework 60 relative to the main frame 20 about a pivot axis indicated generally by the numeral 402. The drum rotation drive system 500 is operative to rotate the drum 150 relative to the framework 60 about an axis of rotation indicated generally by the numeral 502.

The Main Frame 20

Referring to FIG. 1, the main frame 20 provides support for the other components of the machine 10 and must be of suitably rigid construction. As will be appreciated, transient loads and shocks which result from the starting and stopping of rotation of the drum 150, and which result from the tumbling action of the contents within the drum 150, may tend to impart relatively severe transient loads and shocks on components of the machine 10. In order to provide a main frame capable of absorbing these loads without undue flexing or distortion, the main frame is constructed of a relatively heavy steel tubing of generally square cross section. The components of the frame 10 are securely welded or otherwise rigidly fastened together at their points of intersection.

The main frame 20 includes four upright members 22, 24, 26, 28. The upright members 22, 24 are interconnected at four levels by brace members 30, 32, 34, 36. The upright members 22, 24 and their interconnecting brace members 30, 32, 34, 36 extend substantially within a common plane and define one side of the machine 10. The upright members 26, 28 on the opposite side of the machine are interconnected at four levels by identical brace members 30, 32, 34, 36. The uprights 24, 26 extend within a substantially common plane defining the rear of the machine 10, and are interconnected at two levels by brace members 38, 40. The upright members 22, 28 extend in a substantially common plane defining the front of the machine 10. The uprights 22, 28 are interconnected at their upper ends by a brace member 42.

The main frame 20 also includes a pair of support members 44, 46 which extend between and interconnect the brace members 40, 42. An additional pair of support members 48, 50 extend forwardly from the brace member 42 to provide extensions of the support members 44, 46. A pair of track structures 56, 58 are welded to the undersides of the support members 48, 50, 52, 54 to mount the drum cover support system 300 as will be explained in greater detail.

The Drum Support Framework 60

Figure 2:
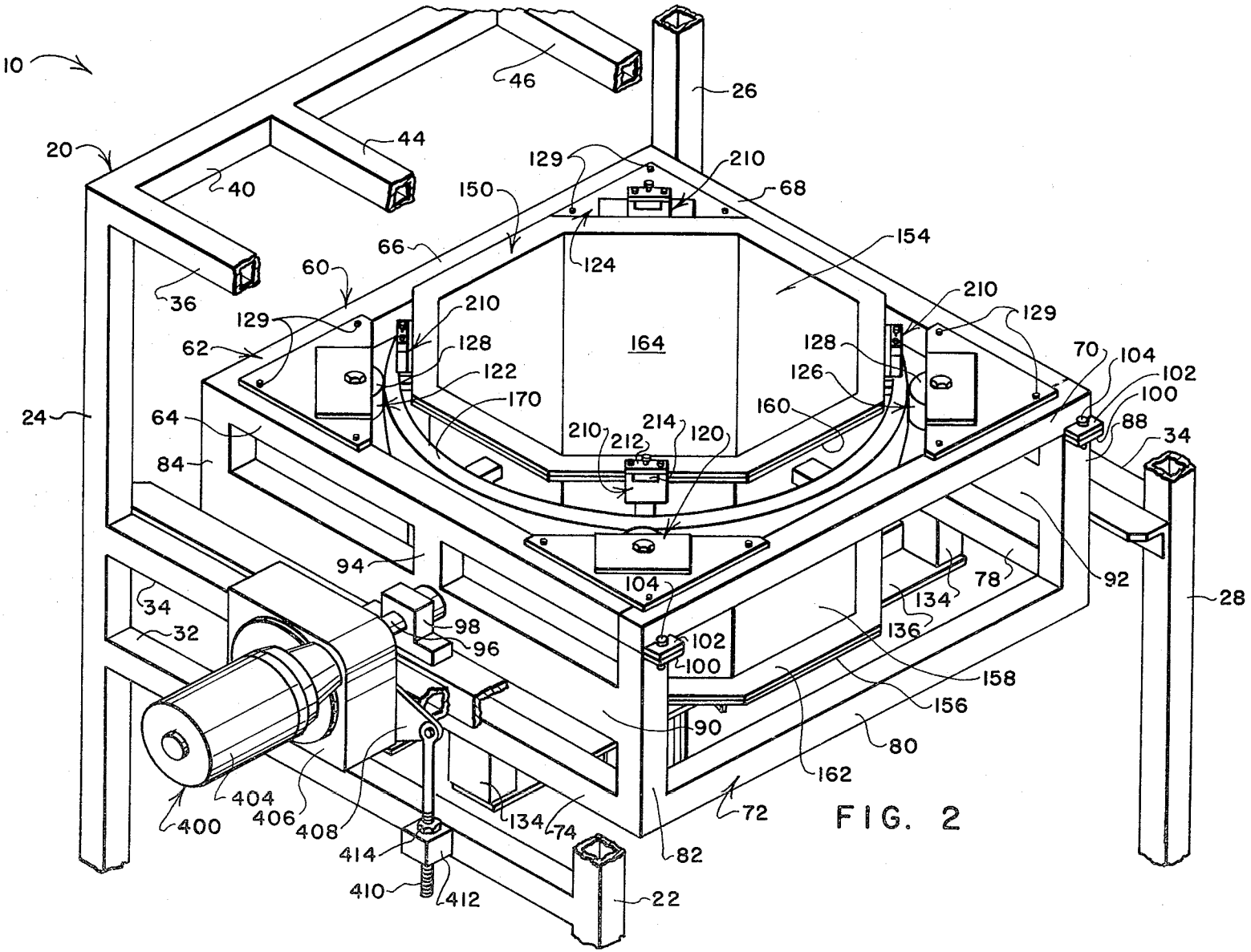
FIG. 2 is an enlarged perspective view of portions of the machine of FIG. 1.

Referring to FIGS. 2 and 3, the drum support framework 60 is of essentially boxlike configuration, having an upper, generally square portion 62 defined by members of 64, 66, 68, 70 and a lower, generally square portion 72 defined by members 74, 76, 78, 80. Uprights 82, 84, 86, 88 interconnect the upper and lower sections 62, 72 at their corners. A pair of braces 90, 92 are provided in opposite sides of the drum support framework 60. The brace 90 interconnects the uprights 82, 84. The brace 92 interconnects the uprights 86, 88. The sides of the framework 60 are additionally provided with short upright braces, indicated generally by the numeral 94, for strengthening the framework 60.

A pair of stub shafts 96 extend from opposite sides of the framework 60. The stub shafts 96 are rigidly secured to the braces 90, 92 and are journaled by a pair of bearing blocks 98. The bearing blocks 98 are supported on the brace numbers 34 at locations on opposite sides of the main frame 20. The stub shafts 96 extend along the pivot axis 502 and cooperate with the bearing blocks 98 to pivotally mount the drum support framework 60 for movement about the pivot axis 502.

While the majority of the intersections of the members forming the drum support framework 60 are welded, the member 70 which the defines the front leg of the upper square 62, is releasably bolted in place. Mounting flanges 100 are provided on uprights 82, 88. Mating mounting flanges 102 are provided on the number 70. Threaded fasteners 104 extend through aligned holes formed in overlying pairs of the mounting flanges 100, 102 to releasably secure the member 70 in position. In the event that the drum 150 must be removed from the cage defined by the drum support framework 60, the member 70 can be removed with ease to provide a path for drum movement.

The drum support framework is provided with four roller assemblies 120, 122, 124, 126 for journaling the open end region of the drum 150. The roller assemblies 120, 122, 124, 126 include commercially available, resiliently covered, ball bearing rollers 128 supported on adjustable mounting brackets 130. Threaded fasteners 129 adjustably mount the roller assemblies 120, 122, 124, 126 on the framework 60 for selective positioning radially inwardly and outwardly relative to the drum 150. The rollers 128 preferably take the form of steel rollers covered with urethane treads.

The drum support framework 60 is also provided with a thrust bearing sleeve 132 for journaling a drive shaft 152 which depends from the drum 150. Four braces 134 depend from the lower square side members 74, 78 and carry a pair of cross members 136, 138. A mounting plate 140 is supported on the cross members 136, 138 at a central location underlying the drum 150. The sleeve 132 is supported in an opening formed through the mounting plate 140.

The Drum 150

The drum 150 has an open end indicated generally by numeral 154, an end wall 156 defining a closed end, and side walls in the form of an octagonal shell 158. The shell 158 cooperates with the end wall 156 to define a chamber adapted to receive finishing media and workpieces to be finished. Outwardly turned flanges 160, 162 are provided near opposite ends of the shell 158. A resilient lining material 164 covers inner wall surfaces of the drum including the inner surface of the end wall 156 and the inner surfaces of the shell 158. The liner 164 also covers the upwardly facing surface of the flange 160. The liner 164 absorbs impacts occuring during the tumbling process and prevents workpieces from being damaged by contact with the drum 150.

A ring-like track 170 is provided around the drum 150 near its open end 154. The rollers 128 carried on the drum support framework 60 are positioned to engage the outer surface of the track 170 to assist in rotatably supporting the drum 150. The rollers 128 can be set to very slightly clear the outer surface of the track 170 when the drum 150 is oriented upwardly, i.e. with its rotation axis 502 extending vertically, whereupon, when the drum 150 is tilted to one side, the pair of the rollers 128 which then underlies the drum 150 will come into supporting engagement with the track 170. Alternatively, the mounting brackets which support the rollers 128 can be set to position all of the rollers 128 in firm engagement with the track 170 to thereby serve supporting and centering functions regardless of the orientation of the drum 150.

The drive shaft 152 is rigidly secured to the end wall 156 and is journaled by the framework sleeve 132. The drive system 500 which is interposed between the drive shaft 152 and the drum support framework 60 will be described later.

The Cover 200

The cover 200 is an octagonal steel plate 202 of a size sufficient to completely overlie the shell flanges 160. A resilient liner 204 is adhered to the underside of the cover plate 202. Aligned openings (not shown) may be provided centrally through the cover plate 202 and through the liner 204 to permit materials to be added to the drum 150 after the cover 200 has been locked in place. Where such aligned openings are provided, they may also operate to prevent the creation of a vacuum condition within the drum 150 during a tumbling process.

A locking system, indicated generally by the numeral 208, is provided for securely releasably retaining the cover 200 in place on the drum 150. The locking system 208 includes drum-carried and cover-carried components.

Figure 6:
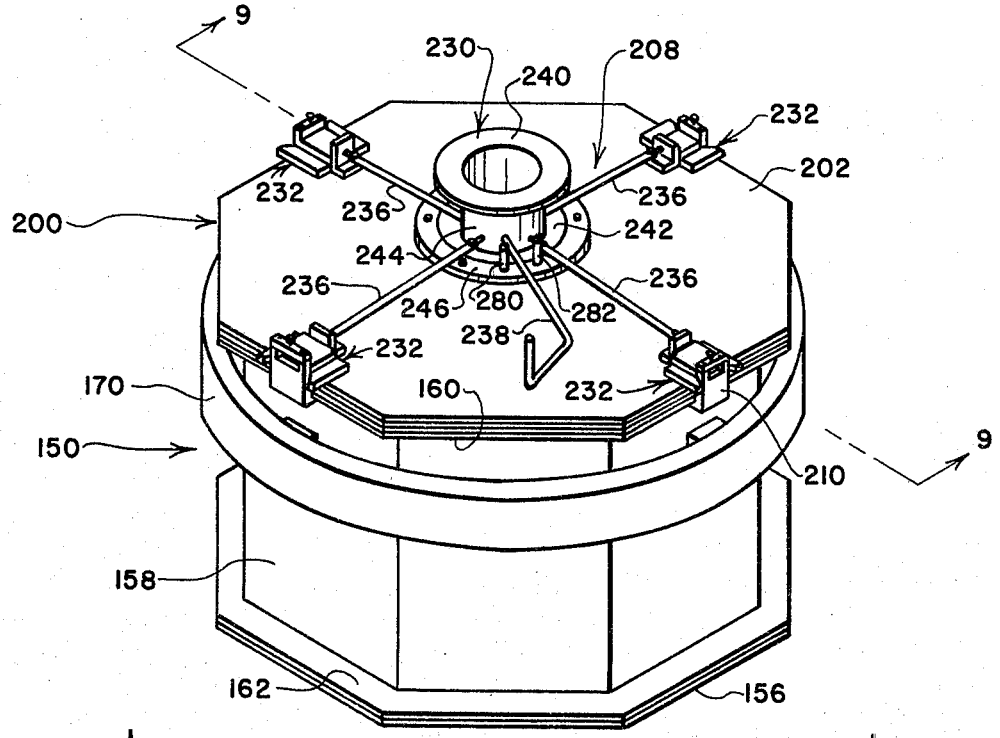
FIG. 6 is a perspective view of the drum with its cover in sealing engagement therewith.
Figure 9:
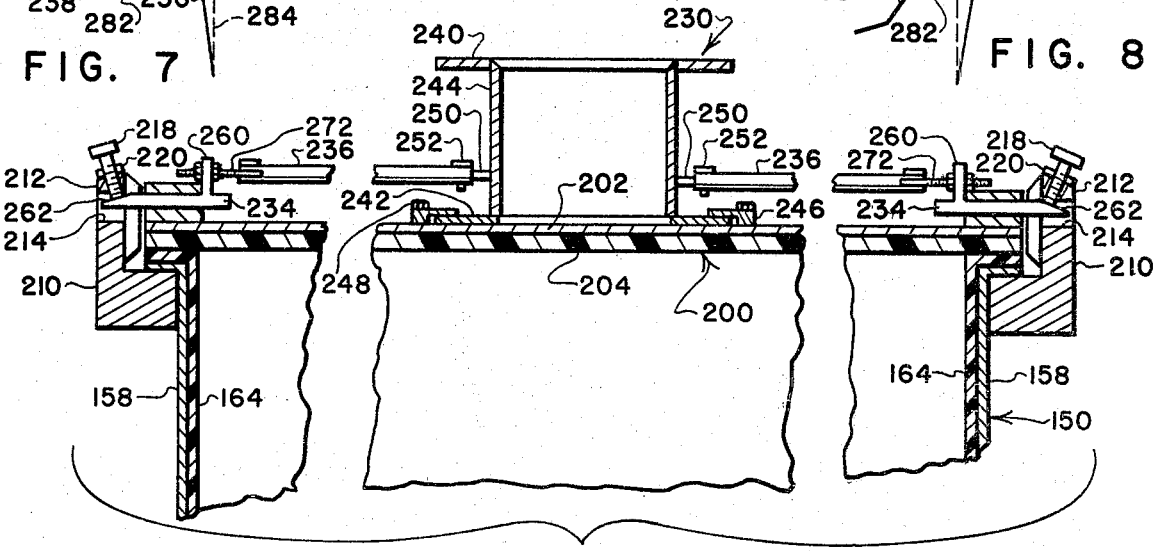
FIG. 9 is a sectional view on an enlarged scale as seen from a plane indicated by a line 9—9 in FIG. 6, with portions of the view being broken away and foreshortened.
Figure 10:
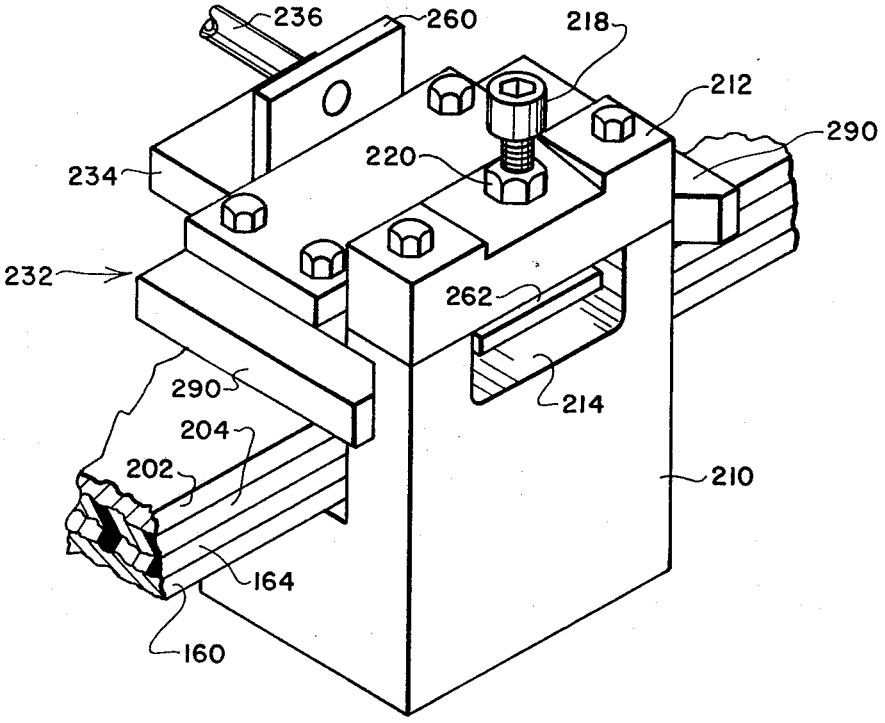
FIG. 10 is a perspective view on an enlarged scale of a portion of the drum cover and drum rim showing one of a plurality of lid locking brackets receiving one of a plurality of cover locking fingers; and, FIG. 11 is a schematic representation of a hydraulic system utilized to rotate the drum.

Referring to FIGS. 6, 9 and 10, the drum-carried components of the locking system 208 include four L-shaped brackets 210 supported at equally spaced positions around the periphery of the open end 154. A mounting bar 212 is secured atop each of the L-shaped brackets 210. A generally rectangular opening 214 is defined between the bar 212 and upstanding portions of its associated bracket 210. Inclined grooves 216 are milled in the top of each of the bars 212. Set screws 218 are threaded into holes formed in each of the bars 212. The holes into which the set screws 218 are threaded extend orthogonally relative to the planes of the bottom surfaces of their associated grooves 216. Locking nuts 220 are carried on the set screws 218 and are adapted to be tightened securely into engagement with the bottom surfaces of the grooves 216 to lock the set screws 218 in desired positions.

The cover-carried components of the locking system 208 include a cylindrical hub 230 rotatably supported atop the central section of the cover 200, four guide assemblies 232 carried near the periphery of the cover 200, four wedge-shaped fingers 234 supported by the guide assemblies 232 for radially inward and outward movement, four links 236 for drivingly interconnecting the rotatable hub 230 and the fingers 234, and a handle 238 for rotating the hub 230 between locked and unlocked positions.

The cylindrical hub 230 has upper and lower outwardly projecting flanges 240, 242 which are interconnected by a tubular stem 244. The lower flange 242 is journaled by an annular collar ring 246 which overlies the flange 242 to rotatably mount the hub 230 atop the cover 200. Fasteners 248 secure the collar ring 246 atop the cover 200. Where aligned openings (not shown) are provided through the cover plate 202 and the liner 204, as discussed previously, the tubular stem 244 communicates with these aligned openings and provides a passage for the introduction of materials into the drum 150.

Four mounting brackets 250 extend radially outwardly from the tubular stem 244 at equidistantly spaced locations around its circumference. Fasteners 252 pivotally connect the brackets 250 with the inner ends of the links 236.

Referring particularly to FIG. 9, the fingers 234 are of elongate configuration and have upstanding mounting legs 260 near their inner ends. Outer ends of the fingers 234 are provided with inclined surfaces 262. The guide assemblies 232 define radially extending paths of movement for the fingers 234 for guiding the fingers 234 into and out of the rectangular openings 214. When the fingers 234 are fully radially extended into the openings 214, their inclined surfaces 262 wedgingly engage the inner ends of the set screws 218 to bias the cover 200 into firm sealing engagement with the rim of the drum 150.

Figure 7:
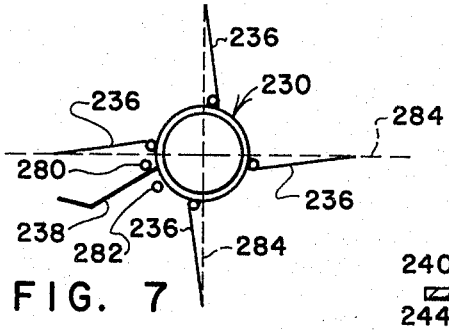
FIGS. 7 and 8 are schematic views illustrating the operation of the cover locking system, with FIG. 7 showing the cover locking system in its locked configuration and FIG. 8 showing this system in its unlocked configuration.
Figure 8:
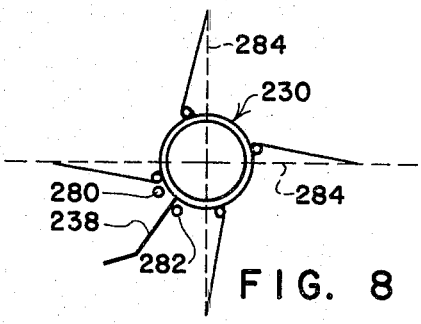

Fasteners 272 pivotally connect the outer ends of the links 236 and the fingers 234. By this arrangement, when the cylindrical hub 230 is rotated counterclockwise to the unlocked position illustrated schematically in FIG. 8, the links 236 retract the fingers 234 from the openings 214, thereby permitting the cover 200 to be removed from the drum 150. When the cylindrical hub 230 is rotated clockwise to the locked position illustrated schematically in FIG. 7, the links 236 extend the fingers 234 into the openings 214 and into wedging engagement with the inner ends of the set screws 218 to clamp the cover 200 securely in sealing engagement with the drum 150.

The handle 238 is welded to the hub 230 and extends outwardly therefrom to facilitate rotation of the hub 230. A pair of upstanding stops 280, 282 are provided on the collar ring 246. When the hub 230 is in the locked position of FIG. 7, the handle 238 engages the stop 280 to prevent further clockwise rotation of the hub 230. When the hub 230 is in the locked position of FIG. 8, the handle 238 engages the stop 282 to prevent further counterclockwise rotation of the hub 230. As will be apparent from the radially extending reference lines 284 provided in FIGS. 7 and 8, the links 236 assume a slightly over-center position when locked, whereby the radially inward compression forces exerted on the links 236 by the wedging action of the fingers 234 engaging the set screws 218 holds the hub 230 in its locked position with the handle 238 firmly engaging the stop 280.

A feature of the described cover locking system lies in the ease with which the clamping force applied to the cover 200 can be adjusted. The set screws 218 can be threaded inwardly or outwardly of their mounting holes to increase or decrease clamping force to secure a good seal between the cover 200 and the drum 150.

Referring to FIG. 10, the guide assemblies 232 also provide a pair of arms 290 which slidably receive opposite sides of the L-shaped brackets 210 to maintain proper rotary alignment of the octagonal cover 200 and the octagonal drum 150.

The Cover Removal and Support System 300

The cover removal and support system 300 includes a carriage 302 which is supported by rollers 304 for movement along the channel-shaped track members 56, 58. The carriage 302 is movable between an extended position overlying the drum cover 200, as shown in FIG. 5, and a retracted position shown in FIGS. 1 and 4.

The carriage 302 includes a generally rectangular carriage frame 310. The rollers 304 are journaled on opposite sides of the carriage frame 310. A pair of posts 312 depend from the carriage frame 310 near its forward end. A shaft 314 extends through aligned holes formed in the posts 312 and is journaled by the posts 312. A pair of L-shaped arms 316 are rigidly connected to the shaft 314.

The arms 316 form opposite sides of a yoke structure. A cross brace 318 extends between and interconnects the arms 316 near their midpoint. A pair of inwardly projecting pins 320 are secured to the arms 316 near their rearward ends. The pins 320 extend toward each other but are spaced apart by a distance slightly greater than the outer diameter of the tubular stem 244 of the hub 230. Pairs of spaced lugs 322 are provided on the underside of the hub flange 240 for receiving the pins 320 therebetween. By this arrangement, the arms 316 may be positioned to project the pins 320 into the spaces between lugs 322 to releasably connect the arms 316 to the cover 200, whereby the cover 200 may be lifted off the drum 150.

A winch 330 is provided for pivoting the arms 316 about the axis of the shaft 314. The winch 330 includes a channel-like frame 332 secured to the carriage frame 310. A hand-operated drive 334 is provided on the frame 332 for rotating a drum 336. A cable 338 has one end secured to the drum and its other end secured to the cross brace 318. An intermediate portion of the cable 338 is reeved around a pulley 340. The pulley 340 is supported on a cross brace 342 which forms a part of the carriage 302.

When the hand operated drive 334 is operated to reeve the cable 338 around the drum 334, the cable 338 is tensioned and causes the arms 316 to pivot upwardly about the axis of the shaft 314. Assuming the pins 320 are in position between the pairs of lugs 322, and assuming the cover locking mechanism is unlocked, the upward pivotal movement of the arms 316 will be effective to lift the cover 200 from the drum 150. The carriage 302 can then be retracted to the position of FIGS. 1 and 4.

Reinstalling the cover 200 on the drum 150 is a simple matter of returning the carriage 302 to a position overlying the drum 150 and operating the winch 330 to lower the cover 200 into proper position.

Figure 4:
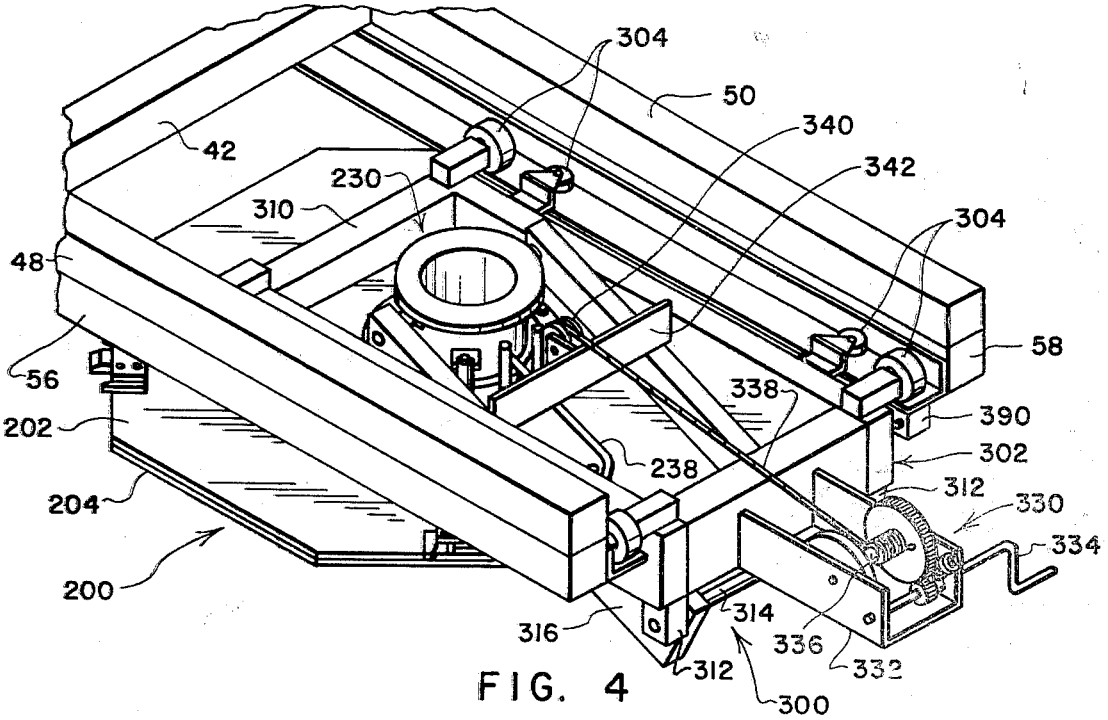
FIGS. 4 and 5 are perspective views of portions of the cover removal and support carriage, with FIG. 4 showing the entire carriage and FIG. 5 showing only a portion thereof.
Figure 5:
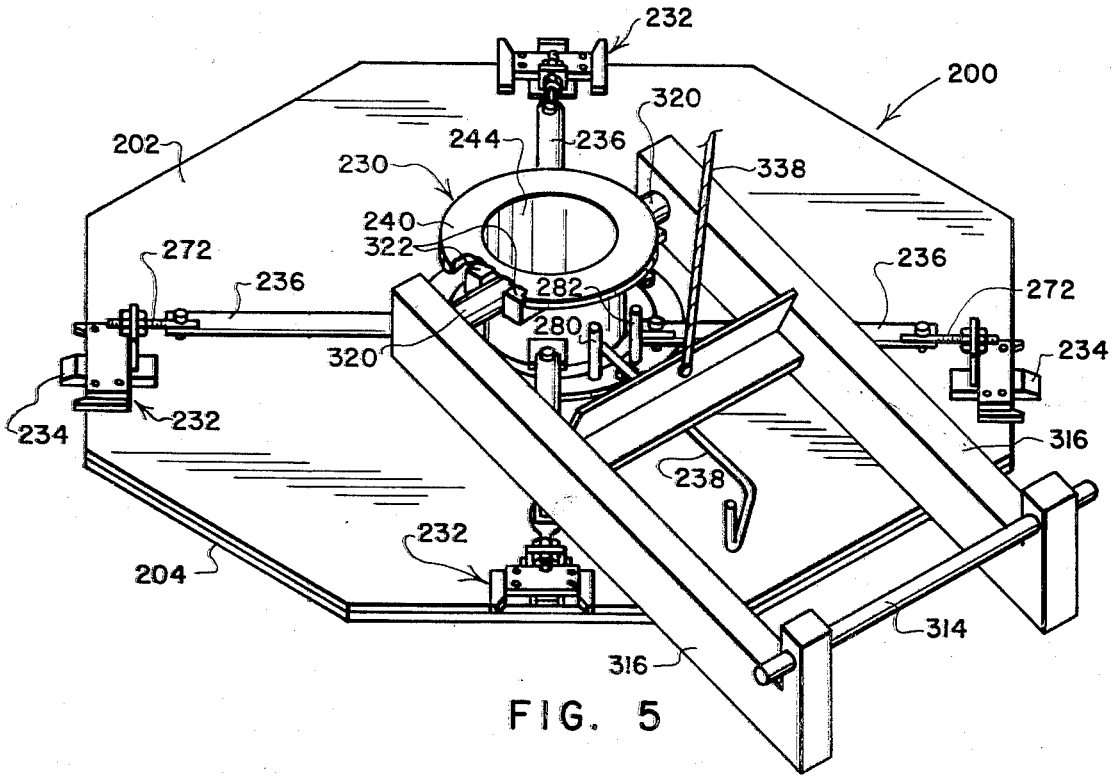

Referring to FIG. 4, a limit switch 390 or other suitable sensor may be provided along the tracks 56, 58 for engaging the carriage 302 to sense when the carriage 302 is in its retracted position. The limit switch 390 may be interfaced with a suitable conventional controllable circuit for preventing operation of some or all machine components when the carriage 302 is out of its retracted position.

The Drum Tilt Drive System 400

The drum tilt drive system 400 includes an electric motor 404 which is coupled through a gearbox 406 to one of the stub shafts 96. A positioning flange 408 extends outwardly of the housing of the gearbox 406. A threaded rod 410 connects with the flange 408. A stop formation 412 is provided on the main frame 20. The threaded rod 410 extends through a hole formed in the stop formation 412 and is secured by lock nuts 414.

A feature of the drum tilt drive system 400 is that it can position the drum 150 in any orientation throughout a 360 degree turning radius. Moreover, the drum tilt drive system 400 can easily reposition the drum 150 repeatedly during a finishing cycle as may be desired to progressively alter the type of finishing action being imparted to work pieces within the drum 150.

The Drum Rotation Drive System 500

Figure 11:
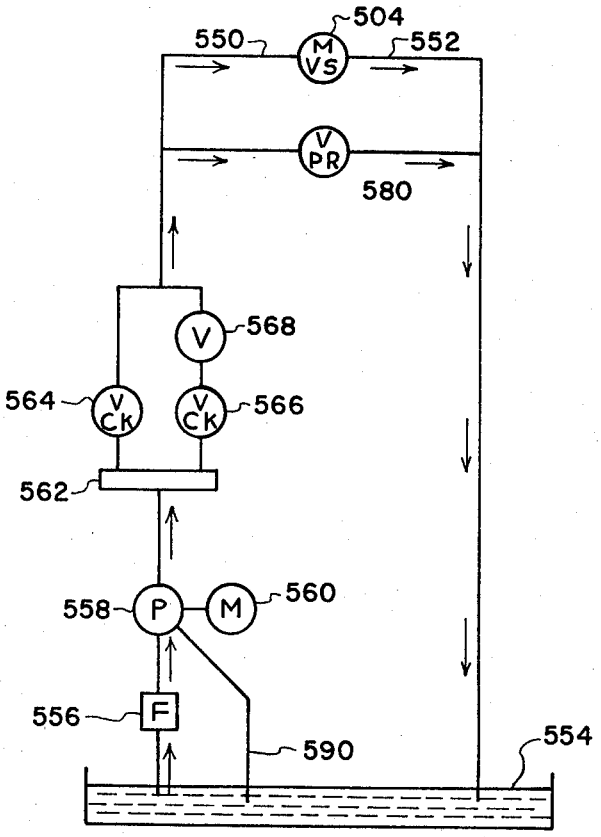

The drum rotation drive system 500 is shown best in FIGS. 3 and 11. The system 500 includes a hydraulic motor 504 which connects directly with the drum drive shaft 152. A shock absorbing mount, indicated generally by the numeral 510, is provided to drivingly interconnect the housing of the hydraulic motor 504 and the drum support framework 60. The mount 510 also assists in absorbing such transient loads and shocks as might otherwise be transmitted through the drive system 500 from the drum 150 to the framework 60.

The mount 510 includes a plurality of rods 512, each of which has one end pivotally connected to the housing of the hydraulic motor 504. The other ends of the rods 512 extend substantially tangently with respect to the housing of the motor 504. Four depending posts 516 are provided on the underside of the cross members 136, 138. The rods 512 extend through holes formed in the posts 516 and carry springs 518 which engage opposite sides of the posts 516 to resiliently mount the motor 504 for limited rotary movement relative to the framework 60 about the rotation axis 502. A similar shock absorbing mount is described in the references Horizontal Axis Machine Patent wherein a rod, a stop post, and springs are provided to mount a belt drive. The tension on the springs 518 may be adjusted to produce desired shock absorbing characteristics as is discussed in detail in the referenced Horizontal Axis Tumbler Patent.

A hydraulic shock absorbing system is also included as a part of the drum rotation drive system 500. Referring particularly to FIG. 11, the hydraulic motor 504 is supplied with hydraulic fluid at about 500–750 pounds per square inch through a high pressure inlet 550. Fluid is exhausted from the motor 504 through a low pressure outlet 552.

Hydraulic fluid is drawn from a reservoir 554 through a filter 556 and is compressed to a high pressure by a variable displacement pump 558. The pump 558 is driven by an electric motor 560.

High pressure fluid from the pump 558 is directed to a sliding valve 562. The valve 562 selectively diverts the high pressure to one of two check valves 564, 566. When the fluid flowing through the check valve 564 is directed to the motor 504, it suffers little or no pressure loss. This "full flow" condition is used for normal operation of the drum 150. When the fluid is diverted through the second check valve 566 and thereafter through a needle or "flow control" valve 568 on its way to the motor 504, the valve 568 acts as a controllably variable flow restricter. This "restricted flow" condition is used when the drum is being accelerated to normal operating speed, or decelerated to rest.

A pressure relief valve 580 is connected across the high pressure inlet 550 and the low pressure outlet 552 at a locaton external of the motor 504. The pressure relief valve 580 senses abnormally high levels of pressure in the high pressure inlet 134 and, under these conditions, operates to divert or bypass hydraulic fluid around the motor 504 to the low pressure outlet 552, thereby avoiding damage to components of the drive system 500. Under normal circumstances, the pressure relief valve 580 is set to a predetermined level of approximately 1,000 pounds per square inch. As long as inlet operating pressure remains in the 500–750 pound per square inch operating range, the pressure relief valve 580 remains closed. A feature which results from the provision of the pressure relief valve 580 is that many of the transient loads and shocks that would otherwise be transmitted through the drum drive system 500 are absorbed.

The pressure relief valve 580 is in addition to a pressure relief valve normally provided internally of the pump 558. The internally provided pressure relief valve operates to divert high pressure fluid in the system to the reservoir 554 in the unlikely event that pressure within the system exceeds a predetermined high level, such as approximately 1,000 pounds per square inch. The function of the internal pressure relief valve is carried out by venting the pump 558 through an auxiliary line 590 which connects to the reservoir 554. The pump-contained pressure relief valve prevents catastrophic failure of the pump 558 and the motor 504 in the presence of excessively high hydraulic pressure.

Operation of the Machine 10

Beginning with the components of the machine 10 in the position shown in FIG. 1, a finishing process is initiated by introducing into the drum 150 a suitable quantity of the desired finishing media together with a suitable quantity of workpieces to be finished. The carriage 302 is then moved from its retracted position to its extended position to situate the cover 200 over the drum 150. The winch 330 is then operated to lower the cover 200 into position on the drum. The lid locking mechanism 208 is then operated to securely clamp the lid 200 in place on the drum, and the carriage 302 is withdrawn to its retracted position.

The tilt drive motor 404 may be actuated to tilt the drum support framework 60 and the drum 150 toward either the front or the rear of the machine 10 to a predetermined inclined attitude. While any angular position from 0 degrees to 90 degrees as measured by the vertical may be selected, the drum 150 is commonly inclined approximately 45 degrees from the vertical during a finishing operation.

The hydraulic motor 504 may be actuated by admitting high pressure hydraulic fluid through the inlet 550 in response to actuation of the pump 558. The slide operated valve 562 is positioned to divert fluid through the valve 568 on its way to the motor 504, whereupon the drum 150 will begin to rotate about its rotation axis 502 and the tumbling process will commence. For most finishing cycles, the drum 150 is brought to a rotation speed of about 5 to 15 revolutions per minute. As the drum 150 approaches the desired speed, the slide valve 562 is actuated to divert fluid through the check valve 564 directly to the motor 504.

After about 10 minutes of tumbling has occurred, the drum 150 may be tilted in the opposite direction for continued rotation. This two-sided type of tumbling action insures that workpieces will be impacted from all directions by the finishing media in a uniform, effective manner.

Once the desired finishing action has been carried out, the slide valve 562 is actuated to restrict the flow of hydraulic fluid to the motor 504 by causing it to be diverted through the orifice 568. The fluid flow is then slowed and its operation terminated, whereupon the rotation of the drum 150 ceases. The tilt drive motor 504 may then be operated to tilt the drum 150 to a vertical orientation for cover removal, whereafter the drum 150 may be tilted to an inverted position for unloading.

During the tumbling process, transient loads and shocks are imparted to the drum drive system 500 as material within the drum 150 is carried upward by the walls of the drum 150 and then falls back to the other side of the drum 150. The two shock absorbing systems provided by the resilient mount 510 and by the pressure relief valve 580 serve to damp these transient loads and shocks to protect all components of the machine 10 from unnecessary wear.

After a given period of machine operation, the resilient lining 164 in the drum 150 becomes worn and requires replacement. It then becomes necessary to remove the entire drum assembly 150 for the purpose of relining. This procedure is facilitated by the presence of the carriage 302. The carriage 302 is moved toward the drum 150 as if the cover 200 were to be removed; but, instead of disengaging the cover locking mechanism, the locking mechanism is kept engaged so that when the winch 330 raises the arms 316, the entire drum assembly 150 is lifted vertically a distance sufficient for the drive shaft 152 to be disengaged from the drum support framework 60. The fasteners 104 which secure the cross member 70 to the remainder of the drum support framework 60 are removed and the member 70 is withdrawn to clear a path for drum removal. Thereafter, the carriage 302 may be retracted to carry with it the drum assembly 150.

In some tumbling operations, the door 200 may not need to be locked in place on the drum 150 but rather can be retained in a retracted position by the cover removal and support system 300.

Conclusion

As will be apparent from the foregoing description the present invention provides a new and improved tumbler apparatus of a heavy duty type having capabilities and features not previously known in the art. By way of example, the drum drive system 500 is not position sensitive and therefore the drum 150 can be driven regardless of the orientation of its rotation axis 502. Furthermore, the drum drive system 500 is not likely to be damaged by chemicals or finishing media inasmuch as the hydraulic drive motor 504 is a sealed unit. As will be apparent to those skilled in the art, tumbler apparatus of this type have wide ranging uses as washers, mixers, and the like.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A tumbler apparatus, comprising:

(a) a drum defining a chamber adapted to receive finishing media and workpieces to be finished, the drum being rotatable about a rotation axis;

(b) a framework supporting the drum for rotation about the rotation axis;

(c) an upstanding frame supporting the framework for movement about a pivot axis for positioning the drum rotation axis in selected orientations;

(d) drum rotation drive means interposed between the framework and the drum for rotating the drum about the rotation axis; and, (e) the drive means including a hydraulic motor and shock absorbing means for minimizing the transmission through the drive means of transient loads and shocks from the drum to the framework.

2. The tumbler apparatus of claim 1 wherein:

(a) the hydraulic motor has an inlet adapted to be connected to a source of pressurized fluid, and an outlet adapted to return hydraulic fluid to the source; and, (b) the shock absorbing means includes:

(i) means resiliently mounting the hydraulic motor on the framework for absorbing at least a portion of such transient loads and shocks that might otherwise tend to be transmitted from the drum to the framework during operation of the machine; and, (ii) bypass means interconnected between the inlet and outlet of the hydraulic motor for bypassing pressurized hydraulic fluid from the inlet directly to the outlet under conditions of predetermined high pressure differential between the inlet and outlet.

3. The tumbler apparatus of claim 2 wherein the resilient mounting means is operable to permit limited rotary movement of the hydraulic motor relative to the framework about the rotation axis.

4. The tumbler apparatus of claim 3 wherein the resilient mounting means includes compression coil spring biasing means extending in a plane substantially orthogonal to the rotation axis, and spring mounting means cooperating therewith for interconnecting the hydraulic motor and the framework to resiliently mount the motor on the framework.

5. The tumbler apparatus of claim 1 wherein the rotation axis and the pivot axis are arranged to intersect at substantially the center of gravity of an assembly of the drum support framework, the drum, the removable member and drum drive means, whereby minimal imbalance forces oppose the pivotal movement of this assembly relative to the upstanding frame.

6. The tumbler apparatus of claim 5 additionally including drum tilt drive means interposed between the upstanding frame and the drum support framework for positioning the drum rotation axis in selected orientations.

7. The tumbler apparatus of claim 1 wherein:

(a) the drum has an open end, a closed end, and a side wall defining the chamber;

(b) the drum rotation axis being defined by the framework to intersect the open and closed ends;

(c) a removable cover for selectively opening and closing the open end of the drum, the cover being completely removable from the drum; and, (d) a drum lid removal and support system movably carried on the upstanding frame for releasably engaging the cover and removing it from the drum to a location out of the path of movement of the drum and the drum support framework.

8. The tumbler apparatus of claim 7 wherein the cover removal and support means includes:

(a) a pair of carriage ways supported on the upstanding frame;

(b) a carriage movable along the carriage ways between a first position overlying the drum and a second position located to one side of the drum; and, (c) cover grasping means supported on the carriage for releasably engaging the cover, for removing the cover from the drum, and for moving the cover to one side of the drum as the carriage moves from the first position to the second position.

9. The tumbler apparatus of claim 8 wherein the cover-grasping mechanism includes a winch for raising and lowering the cover when the carriage is in its first position.

10. The tumbler apparatus of claim 8 additionally including sensing means operable to detect the presence of the carriage in its second position.

11. The tumbler apparatus of claim 1 wherein the drive means includes:

(a) a variable speed motor interposed between the framework and the drum; and, (b) a shock-absorbing mechanism associated with the motor to absorb transient loads occurring during a tumbling operation.

12. The tumbling apparatus of claim 11 wherein:

(a) the variable speed motor is a hydraulic motor having a high pressure fluid inlet and a low pressure fluid outlet; and, (b) the shock-absorbing mechanism includes a pressure relief valve interposed between the high pressure fluid inlet and the low pressure fluid outlet, the pressure relief valve being responsive to fluid inlet pressure above a predetermined level to divert fluid from the high pressure inlet to the low pressure outlet when the predetermined level is exceeded.

13. The tumbling apparatus of claim 12, wherein the pressure relief valve is at a location external of the motor.

14. The tumbler apparatus of claim 1 wherein the drum has a removable cover a locking mechanism for securing the cover to the drum, the locking mechanism comprising:

(a) a plurality of brackets connected to the drum and disposed about the periphery of the drum;

(b) a plurality of fingers engageable with the brackets, the fingers being carried by the cover and being disposed about the periphery of the cover; and, (c) an actuating mechanism for moving the fingers into and out of engagement with the brackets, the actuating mechanism including links emanating outwardly from a rotatable hub located at the center of the cover.

15. The tumbler apparatus of claim 14, wherein:

(a) the fingers have inclined surfaces formed thereon for wedgingly engaging the brackets to clamp the cover securely into engagement with the drum; and, (b) each of the brackets includes an adjustable member for engaging its associated finger to permit ready adjustment of the clamping force which obtains when its finger is wedgingly received therein.

16. The tumbler apparatus of claim 15, wherein the adjustable members comprise adjustable set screws arranged to engage the inclined surfaces of the fingers.

17. The tumbler apparatus of claim 1 wherein the framework supporting the drum is configured to cage the drum therein, and the framework includes a readily removable member which, when removed, permits largely unobstructed access to the drum to facilitate drum removal and replacement.

18. The tumbler apparatus of claim 17 wherein:

(a) the framework is comprised of elongate members secured together to define a boxlike configuration; and, (b) a pair of stub shafts extend from opposite sides of the framework along the pivot axis.

19. The tumbler apparatus of claim 17 wherein:

(a) the removable member is secured to the remainder of the framework by fasteners; and, (b) the remainder of the framework is assembled permanently by welds.

20. The tumbler apparatus of claim 7 additionally including locking means for securing the cover to the drum, the cover and the drum being removable by the drum lid removal and support system as a unit from the drum support framework.

21. The tumbler apparatus of claim 1 wherein:

(a) the drum has an open end, a closed end, and a side wall cooperating with the closed end to define a chamber adapted to receive finishing media and workpieces to be finished;

(b) the framework includes a first part extending about the closed end of the drum, and a second part extending about the periphery of the open end of the drum; and, (c) the framework further includes first and second mounting means which cooperate to journal opposite end regions of the drum for rotation about the rotation axis.

22. The tumbler apparatus of claim 21 wherein:

(a) the first mounting means includes cooperable formations carried on the closed end of the drum and on the first part, the cooperable formations serving to journal the drum within the vicinity of its closed end; and, (b) the second mounting means includes a plurality of rollers carried on the second part and being disposed at spaced locations about the periphery of the open end, the rollers being engageable with the drum in the vicinity of its open end for assisting the first mounting means in supporting the drum for rotation about the rotation axis.

23. The tumbler apparatus of claim 22 wherein:

(a) the framework has side members which form an essentially box-like cage about the drums; and, (b) the rollers are four in number and are supported at four corners of the box-like cage defined by the side members.

24. The tumbler apparatus of claim 22 wherein the first mounting means includes:

(a) a shaft mounted on the closed end of the drum and extending away therefrom along the axis of rotation; and, (b) thrust bearing means carried on the first part and journaling the shaft.

* * * * *